United States Patent [19]

Kulik et al.

[11] 4,190,546

[45] Feb. 26, 1980

[54] TRACTION FLUID

[75] Inventors: Stanley Kulik, Hawley, near Camberley; Anthony M. Smith, Ashford, both of England

[73] Assignee: The British Petroleum Company Limited, Middlesex, England

[21] Appl. No.: 926,233

[22] Filed: Jul. 20, 1978

[30] Foreign Application Priority Data

Aug. 27, 1977 [GB] United Kingdom ..... 36091/77

[51] Int. Cl.[2] ..... C10M 1/50; C10M 1/16; C10M 1/20

[52] U.S. Cl. ..... 252/49.6

[58] Field of Search ..... 252/49.6, 78.3

[56] References Cited

U.S. PATENT DOCUMENTS

| | | | |
|---|---|---|---|
| 3,578,596 | 5/1971 | Conway | 252/49.6 X |
| 3,791,488 | 2/1974 | Rowe et al. | 252/49.6 X |
| 4,046,703 | 9/1977 | Duling et al. | 252/59 |
| 4,059,534 | 11/1977 | Morro et al. | 252/49.6 X |
| 4,097,393 | 6/1978 | Cupper et al. | 252/78.3 X |

*Primary Examiner*—W. J. Shine

*Attorney, Agent, or Firm*—Morgan, Finnegan, Pine, Foley & Lee

[57] ABSTRACT

A traction fluid comprises from 50 to 90% wt of a naphthenic hydrocarbon or mixture of naphthenic hydrocarbons, from 8 to 40% wt of a silicone fluid and from 2 to 10% wt of a co-solvent which ensures complete miscibility between the naphthenic hydrocarbon and silicone fluid, the percentages being by weight of the three components. The silicone fluid improves the low temperature properties of the fluid without substantial damage to the good traction properties of the naphthenic hydrocarbons.

Preferred co-solvents are aromatic hydrocarbons or aromatic esters.

5 Claims, No Drawings

TRACTION FLUID

This invention relates to traction fluids containing naphthenic components.

Traction fluids are used as lubricants and coolants for drive mechanisms in which the drive is transmitted through rollers or cones, e.g. continuously variable transmissions. Such transmissions are used on certain aircraft and are of current interest in road vehicles because of their economic use of fuel.

Traction fluids are required to have a relatively low viscosity, even at sub-zero temperatures, but a high viscosity under the conditions of high shear and high pressure existing in the nip of the transmissions rollers. Naphthenic hydrocarbons have been found to have good viscosity characteristics at high pressure and particularly suitable napthenic hydrocarbons are alkylated dicyclohexyl methanes. However, these naphthenic hydrocarbons can have relatively high viscosities at low temperatures and this limits their suitability for use in cold weather. It is desirable that an aircraft traction fluid should have a viscosity at −40° F. not exceeding 13,000 cS, whereas, with certain naphthenic hydrocarbons, viscosities in excess of 3000,000 cS at −40° F. have been determined.

One solution to the problem would be to blend the naphthenic hydrocarbons with another liquid with a lower viscosity at lower temperatures, but if this is done, it is important that the other liquid should be fully compatible with the naphthenic hydrocarbons and should have the minimum adverse effect on the high pressure viscosity characteristics. The present invention proposes certain liquids which fulfil these requirements.

According to the present invention a traction fluid comprises from 50 to 90% wt of a naphthenic hydrocarbon or mixture of naphthenic hydrocarbons, from 8 to 40% wt of a silicone fluid and from 2 to 10% wt of a co-solvent which ensures complete miscibility between the naphthenic hydrocarbon and silicone fluid, the percentages being by weight of the three components.

The preferred naphthenic hydrocarbons are alkylated dicyclohexyl methanes. There may be one or more alkyl groups on the cyclohexyl rings, but preferably the group or groups are on one ring only. In a particularly preferred embodiment there is at least one tertiary alkyl group, e.g. a group $-C(CH_3)_3$. Each alkyl group may have from 1 to 7 carbon atoms and the total number of carbon atoms in the alkyl groups may be from 1 to 10. A suitable naphthenic traction fluid is that sold by Monsanto Limited as Santotrac 40.

Silicone fluids are well known materials having the general formula:

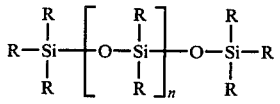

where R is hydrocarbyl and n can vary widely depending on the viscosity and volatility required in the fluid. In the present invention it has been found that silicone fluids can improve the low temperature properties of a traction fluid without being too volatile and with little adverse effect on the high pressure properties of the fluid. Preferred silicone fluids are those having kinematic viscosities of from 50 to 100 centistokes at 25° C., such materials having a volatility loss of about 2.5% after 4 hours at 250° C. and kinematic viscosities of from 400 to 900 cS at −40° F.

The hydrocarbyl groups in the silicone may be $C_1$–$C_6$ alkyl or aryl or a mixture of both. A preferred silicone fluid has a mixture of methyl and phenyl groups with, preferably, from 15 to 25 methyl groups per phenyl group. To give the preferred viscosities, n in the formula above may be from 25 to 40.

Suitable silicone fluids are those sold by Dow Corning International Limited as Dow Corning 510 fluids.

It has been found, however, that naphthenic hydrocarbons and silicone fluids are not fully miscible, due, it is believed, to differences in their polarity. The naphthenic hydrocarbons are relatively non-polar, whereas the silicone fluids are relatively polar. The traction fluids of the present invention include, therefore, a co-solvent which ensures complete miscibility between the other two components, e.g. no separation after storage at room temperature for at least 3 months.

Examples of suitable co-solvents are aromatic hydrocarbons, particularly alkyl aromatics and/or polycyclic aromatics, (e.g. naphthalene with or without one or more $C_1$ to $C_4$ alkyl groups) and aromatic ethers. These preferred co-solvents, in order of preference, are 1-methyl-naphthalene, diphenyl ether and anisole (methyl phenyl ether). The co-solvents, besides promoting miscibility, should also be relatively involatile, e.g. have a boiling point above 150° C. and have relatively good traction properties in themselves. Long chain alcohols, e.g. nonyl phenol, octanol and decanol have been found to be less effective than the preferred compounds given above.

The proportions of naphthenic hydrocarbon, silicone fluid and co-solvent are selected to give the required low temperature viscosity with maintained traction efficiency. Preferred proportions may be within the following ranges in % wt. by weight of the three components.

| | |
|---|---|
| Naphthenic hydrocarbon | 57–80% wt. |
| Silicone fluid | 17–35% wt. |
| Co-solvent | 3–9% wt. |

The traction fluid may contain other known additives to improve particular qualities, e.g. anti-oxidants, corrosion inhibitors or anti-wear additives.

The components of the traction fluid may be combined by simple mixing at room or moderately elevated (e.g. 50° C.) temperature.

The invention is illustrated by the following example.

EXAMPLE 1

66.5% wt of Santotrac 40 (an alkylated dicyclohexyl methane sold by Monsanto Limited) was blended with 28.5% wt of DC 510/50 Silicone Fluid, (a methyl phenyl silicone sold by Dow Corning Limited) and 5% wt of diphenyl ether as co-solvent at 40° C. and stirred until complete miscibility occurred. The sample was designated Blend 1.

The viscosities of the blend were determined at different temperatures and are shown in Table 1 below. The viscosities of pure Santotrac 40 and another commercially available traction fluid based on phthalate esters are also included for comparison.

Table 1

| Kinematic viscosities at | −40° F. | 100° F. | 210° F. | 300° F. | 320° F. |
|---|---|---|---|---|---|
| Blend 1 | 8,545 | 18.04 | 4.64 | | 2.18 |
| Santotrac 40 | >300,000* | 22.5 | 3.66 | 1.69 | |
| Phthalate ester fluid | >200,000* | 29.49 | 4.31 | 1.91 | |

*extrapolated extrapolated results

Traction coefficients were also measured in a twin disc machine at temperatures between 40° and 43° C. and at rolling speeds between 4.80 and 5.08 m/s. The results are shown in Table 2 below and compared with pure Santotrac 40 and the phthalate ester fluid.

Table 2

| Pressure at contact zone p.s.i. | 155,000 | 212,000 | 293,000 |
|---|---|---|---|
| Blend 1 | 0.090 | 0.102 | 0.106 |
| Santotrac 40 | 0.105 | 0.111 | 0.113 |
| Phthalate ester fluid | 0.068 | 0.087 | 0.090 |

Table 1 shows that Blend 1 of the present invention had a much lower viscosity at −40° F. than the other fluids. Table 2 shows that Blend 1 also had better traction coefficients than the commercial phthalate ester fluid. The traction coefficients were lower than those of Santotrac 40 but not significantly so.

EXAMPLE 2

Further blends were made up as described in Example 1 using Santotrac 40 as the naphthene, DC510/50 and DC510/100 as the silicone fluids, and diphenyl ether, anisole and 1-methyl- naphthalene as the co-solvents. The proportions of the components and the kinematic viscosities obtained were as shown in Table 3 below.

Table 3

| Blend Number | Blend Composition % wt | | | Kinematic Viscosity at | | | |
|---|---|---|---|---|---|---|---|
| | Naphthene | Silicone Fluid | Co-solvent | −40° F. | 100° F. | 210° F. | 320° F. |
| 2 | 90% | 10% DC510/50 | nil | did not flow | 21.78 | 4.13 | 1.68 |
| 3 | 80% | 20% DC510/50 | nil | did not flow | 21.55 | 4.71 | 2.05 |
| 4 | 70% | 30% DC510/50 | nil | did not flow | 21.65 | 5.25 | 2.39 |
| 5 | 80% | 20% DC510/100 | nil | did not flow | 25.54 | 6.37 | 2.66 |
| 6 | 70% | 30% DC510/100 | nil | did not flow | 28.34 | 7.27 | 3.41 |
| 7 | 60% | 40% DC510/100 | nil | did not flow | 32.11 | 9.06 | 4.35 |
| 8 | 66.5% | 28.5% DC510/50 | 5% anisole | 3440 | 14.86 | 4.18 | 2.05 |
| 9 | 66.5% | 28.5% DC510/50 | 5% DPE* | 8545 | 18.04 | 4.64 | 2.18 |
| 10 | 66.5% | 28.5% DC510/50 | 5% 1-MN** | 7020 | 17.71 | 4.62 | 2.07 |
| 11 | 57% | 38% DC510/50 | 5% anisole | 1800 | 15.84 | 4.77 | 2.37 |
| 12 | 57% | 38% DC510/50 | 5% DPE* | 3645 | 18.58 | 5.22 | 2.48 |
| 13 | 57% | 38% DC510/50 | 5% 1-MN** | 3300 | 18.40 | 5.27 | 2.52 |

*DPE = diphenyl ether
**1-MN = 1-methyl-naphthalene

Blends 2 to 7 of Table 3 show that mixtures of naphthene and silicone fluid without any co-solvent do not have good low temperature properties, presumably because the components are not miscible and the silicone fluid is unable to modify the poor low temperature properties of the naphthene. Blends 8 to 13 of the table show, however, that as little as 5% wt of three different co-solvents has a marked effect giving blends of relatively low viscosity even at −40° F.

Blends 9 and 10 of Table 3 were also tested to determine their traction co-efficients using the test and machine of Example 1. (Blend 9 was, in fact, a repeat of blend 1 of Example 1). The results are shown in Table 4 below and compared with the results with pure Santotrac 40.

Table 4

| Traction Test Conditions | | Traction Co-efficient | | |
|---|---|---|---|---|
| Rolling speed m/s | Max. Hertz contact pressure p.s.i. | pure naphthene | Blend 9 | Blend 10 |
| 0.80 | $1.52 \times 10^5$ | 0.115 | 0.102 | 0.103 |
| 1.60 | $2.26 \times 10^5$ | 0.116 | 0.106 | 0.107 |
| 3.20 | $2.54 \times 10^5$ | 0.114 | 0.106 | 0.105 |
| 4.80 | $2.92 \times 10^5$ | 0.113 | 0.106 | 0.107 |

The results of Table 4 confirm the results of Table 2 and Example 1 and the conclusions drawn therefrom.

We claim:

1. A traction fluid comprising from 50 to 90% wt of a naphthenic hydrocarbon or mixture of naphthenic hydrocarbon which is one or more alkylated dicyclohexyl methanes, from 8 to 40% wt of a silicone fluid and from 2 to 10% wt of a co-solvent which is an aromatic hydrocarbon or aromatic ether which ensures complete miscibility between the naphthenic hydrocarbon and silicone fluid, the percentages being by weight of the three components.

2. A traction fluid as claimed in claim 1 wherein the silicone fluid has a kinematic viscosity of from 50 to 100 centistokes at 25° C.

3. A traction fluid as claimed in claim 2 wherein the silicone fluid contains a mixture of methyl and phenyl groups with from 15 to 25 methyl groups per phenyl group.

4. A traction fluid as claimed in claim 1, 2 or 3 wherein the co-solvent is 1-methyl-naphthalene, diphenyl ether or anisole.

5. A traction fluid as claimed in claim 1, 2 or 3 wherein the proportions of the components are:

| | |
|---|---|
| Naphthenic hydrocarbon | 57–80% wt. |
| Silicone fluid | 17–35% wt. |
| Co-solvent | 3–9% wt. |

* * * * *